United States Patent [19]

Liautaud

[11] 4,190,839

[45] Feb. 26, 1980

[54] MOBILE ANTENNA INCLUDING QUICK-RELEASE MOUNTING

[75] Inventor: James P. Liautaud, Cary, Ill.

[73] Assignee: American Antenna Corporation, Elgin, Ill.

[21] Appl. No.: 860,247

[22] Filed: Dec. 13, 1977

[51] Int. Cl.[2] ..... H01Q 1/32; H01Q 9/18

[52] U.S. Cl. ..... 343/715; 343/749; 343/888; 343/900

[58] Field of Search ..... 343/711-715, 343/749, 750, 745, 850, 900, 901, 880, 882, 883, 906, 888

[56] References Cited

U.S. PATENT DOCUMENTS

| | | | |
|---|---|---|---|
| 4,047,779 | 9/1977 | Klancnik | 343/715 |
| 4,058,811 | 11/1977 | Gauss et al. | 343/715 |

*Primary Examiner*—David K. Moore

*Attorney, Agent, or Firm*—Lockwood, Dewey, Alex & Cummings

[57] ABSTRACT

A mobile antenna adapted to be mounted to a motor vehicle includes a vertical radiating element, an antenna base from which the radiating element extends, and a cylindrical mounting pin for mounting the base to a body panel of the vehicle. The mounting pin establishes at one end a first quick-release bayonet-type connection to the antenna base, and a second quick-release bayonet-type connection to a skirt member positioned between the base and the body panel. The base includes a socket for receiving the pin, and a contact member within the socket which engages tabs contained on a first electrically conductive end cap molded into the pin housing to mechanically and electrically connect the pin to the base. The other end of the pin includes a second electrically-conductive end cap which receives a coaxial cable and establishes an electrical connection between the shield of the cable and the inside surface of the body panel. In use the pin draws the skirt tight against the exterior surface of the body panel so as to allow the antenna base to be removed when not in use.

23 Claims, 14 Drawing Figures

FIG. 7
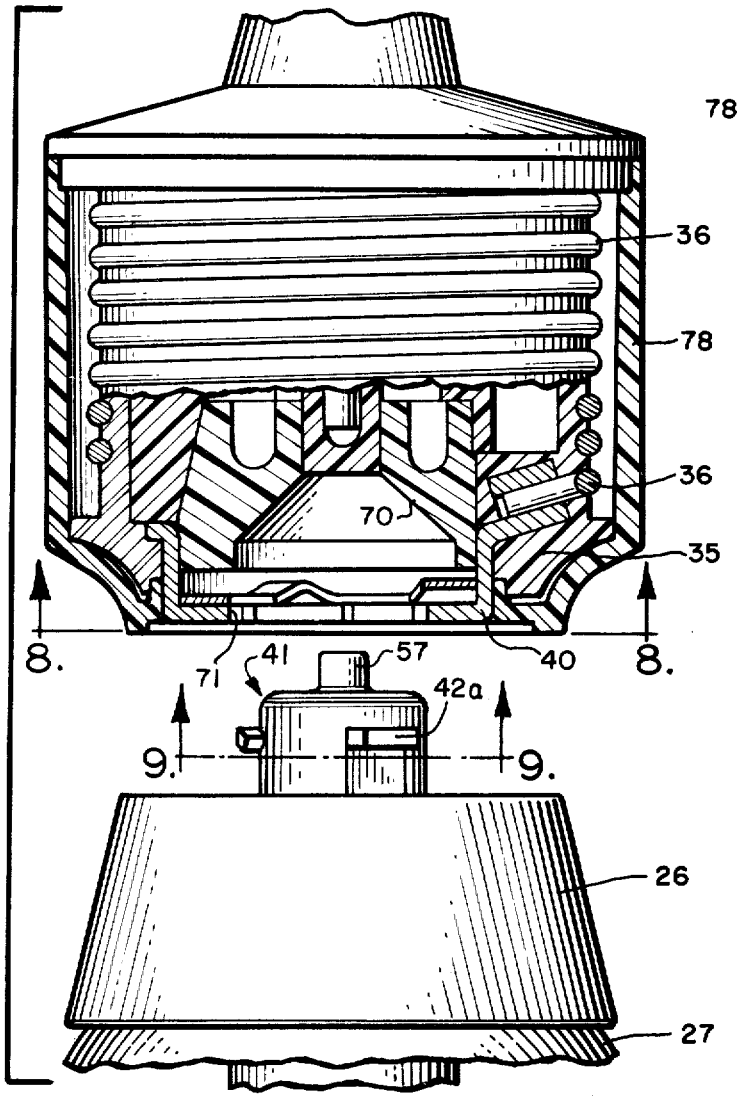
FIG. 10
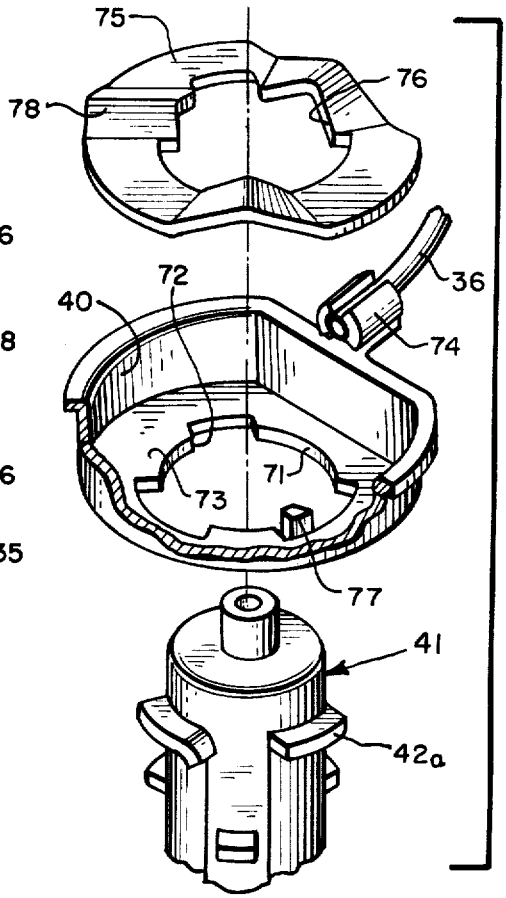
FIG. 11
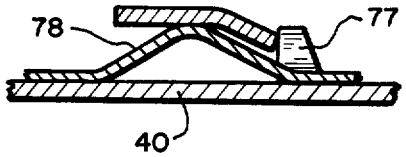
FIG. 8
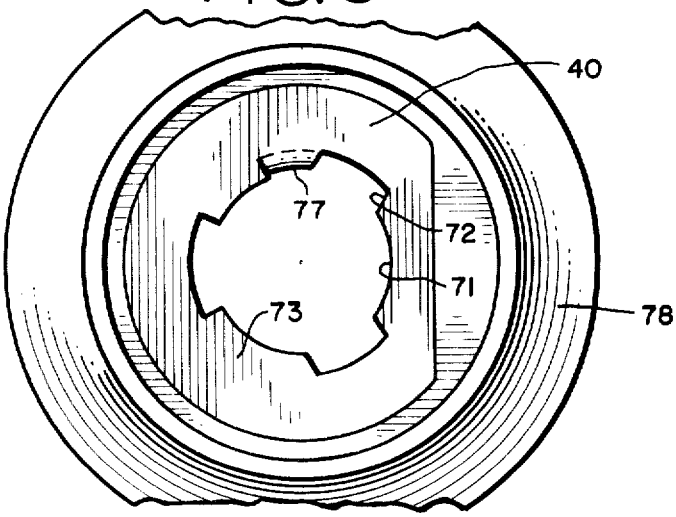
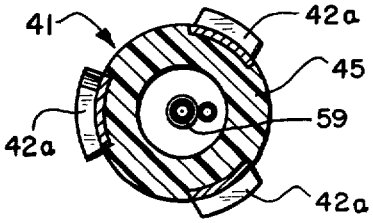
FIG. 9

MOBILE ANTENNA INCLUDING QUICK-RELEASE MOUNTING

BACKGROUND OF THE INVENTION

The present invention relates generally to antennas, and more particularly to a mobile antenna which may be removably mounted to the exterior surface of a motor vehicle body panel.

In recent years the increased use of personal mobile communications equipment, particularly, equipment intended for use on the Citizens' Band, has created a need for high-frequency antennas suitable for mounting on the external surfaces of automobiles and other vehicles. Preferably, these antennas are removably mounted to allow the antenna to be removed when not in use, and to avoid the need for a mounting hole in the vehicle body panel. Removably mounted antennas typically include means for attaching the base of the antenna to the lip or edge of a movable body panel, such as a truck lid, or include a permanent magnet or rubber section cup which engages the body panel surface.

Unfortunately, prior art antenna constructions wherein the antenna base was removable were generally complicated in construction and therefore unnecessarily expensive to manufacture. Furthermore, such antennas typically utilized a threaded connection between the base and the antenna mounting assembly, which was not only inconvenient in that the user had to apply many turns to the base to separate or install the antenna, but also introduced the possibility of damage to the antenna as a result of the cross-threading or contamination of the threads.

Accordingly, it is a general object of the present invention to provide a new and improved antenna which may be removably mounted to a body panel.

It is another object of the present invention to provide a new and improved mobile antenna wherein the base and radiating elements of the antenna can readily be removed without affecting the alignment of the antenna or disconnecting the electrical connection to the antenna.

SUMMARY OF THE INVENTION

The invention is directed to a mobile antenna adapted to be mounted to a body panel. The assembly includes a generally vertical radiating element, and an antenna base member for supporting the radiating element in a substantially vertical position. Means comprising a mounting pin are provided for mounting the base member to the body panel, the mounting pin being adapted at one end for twist-lock engagement with a socket provided in the base, and for attachment to the body panel at the other end thereof. In a preferred construction of the antenna, the mounting pin establishes electrical contact at its one end between a loading coil contained within the base and the center conductor of a coaxial cable which is received at its other end, and between the shield of the coaxial cable and the body panel.

BRIEF DESCRIPTION OF THE DRAWINGS

The features of the present invention, which are believed to be novel, are set forth with particularity in the appended claims. The invention, together with the further objects and advantages thereof, may best be understood by reference to the following description taken in conjunction with the accompanying drawings, in the several figures of which like reference numerals identify like elements, and in which:

FIG. 7 is a front elevational view, partially in cross-section and partially broken away for clarity, of the antenna showing the quick-release connection between the antenna base and mounting members.

FIG. 8 is a plan view of the antenna base bottom surface showing the socket portion of the quick release mechanism taken along line 8—8 of FIG. 7.

FIG. 9 is a cross-sectional view of the mounting pin of the antenna taken along line 9—9 of FIG. 7.

FIG. 10 is an exploded perspective view of certain elements of the antenna which establish the releasable connection between the antenna base and antenna mounting pin.

FIG. 11 is an isolated view partially in elevation and partially in section showing the retention of the connector pin by the antenna base member.

DESCRIPTION OF THE PREFERRED EMBODIMENT

Figure 1:
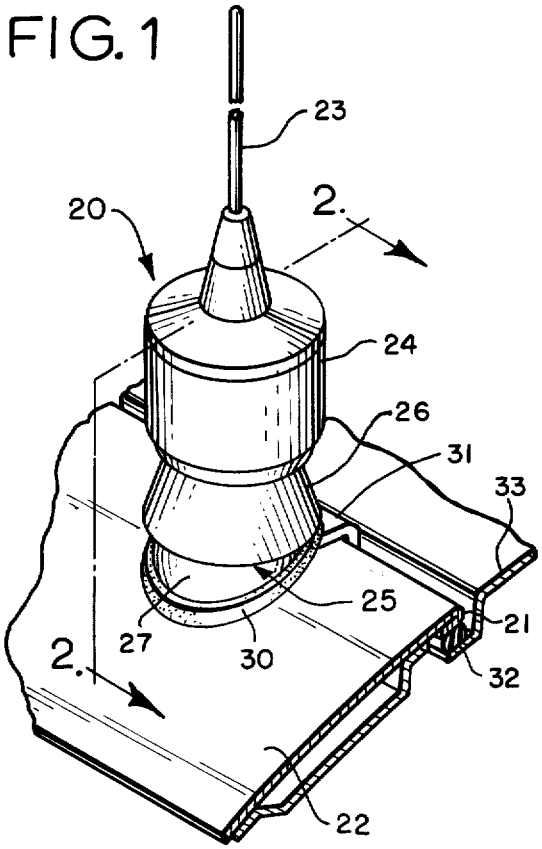
FIG. 1 is a perspective view of a mobile antenna constructed in accordance with the invention mounted on the lip of a motor vehicle body panel.

Referring to the Figures, and particularly to FIG. 1, a mobile antenna 20 constructed in accordance with the invention is shown secured to the lip or edge 21 of a body panel 22, such as a truck lid, on an automobile or other motor vehicle. Preferred constructions for this antenna and mounting arrangement therefore as described in the copending applications of James P. Liautaud entitled "Mobile Antenna," Ser. No. 860,236; "Mobile Antenna With Adjustable Radiating Element," Ser. No. 860,245; "Mobile Antenna Mounting Assembly," Ser. No. 860,237; and "Antenna Mounting Adaptor," Ser. No. 860,234, filed concurrently herewith.

Basically, the antenna includes a vertical radiating element 23 which is retained in an antenna base member 24 from which the whip portion extends an adjustable length to permit fine tuning of the antenna. The antenna base 24 is, in this embodiment, releasably affixed on an angularly adjustable antenna mounting assembly 25. This assembly includes a skirt member 26 which is mounted for movement on a semi-hemispherical shell 27. The generally flat bottom surface of shell 27 rests in a protective grommet or pad 30 which contacts body panel 22. A C-shaped clip 31 extends from one side of shell 27 to engage the edge 21 of body panel 22. In a typical trunk-lid mounting application the end of clip 31 is seated within a channel 32 forming the edge of an adjacent body panel 33 to which the trunk lid 22 is hinged.

Figure 2:
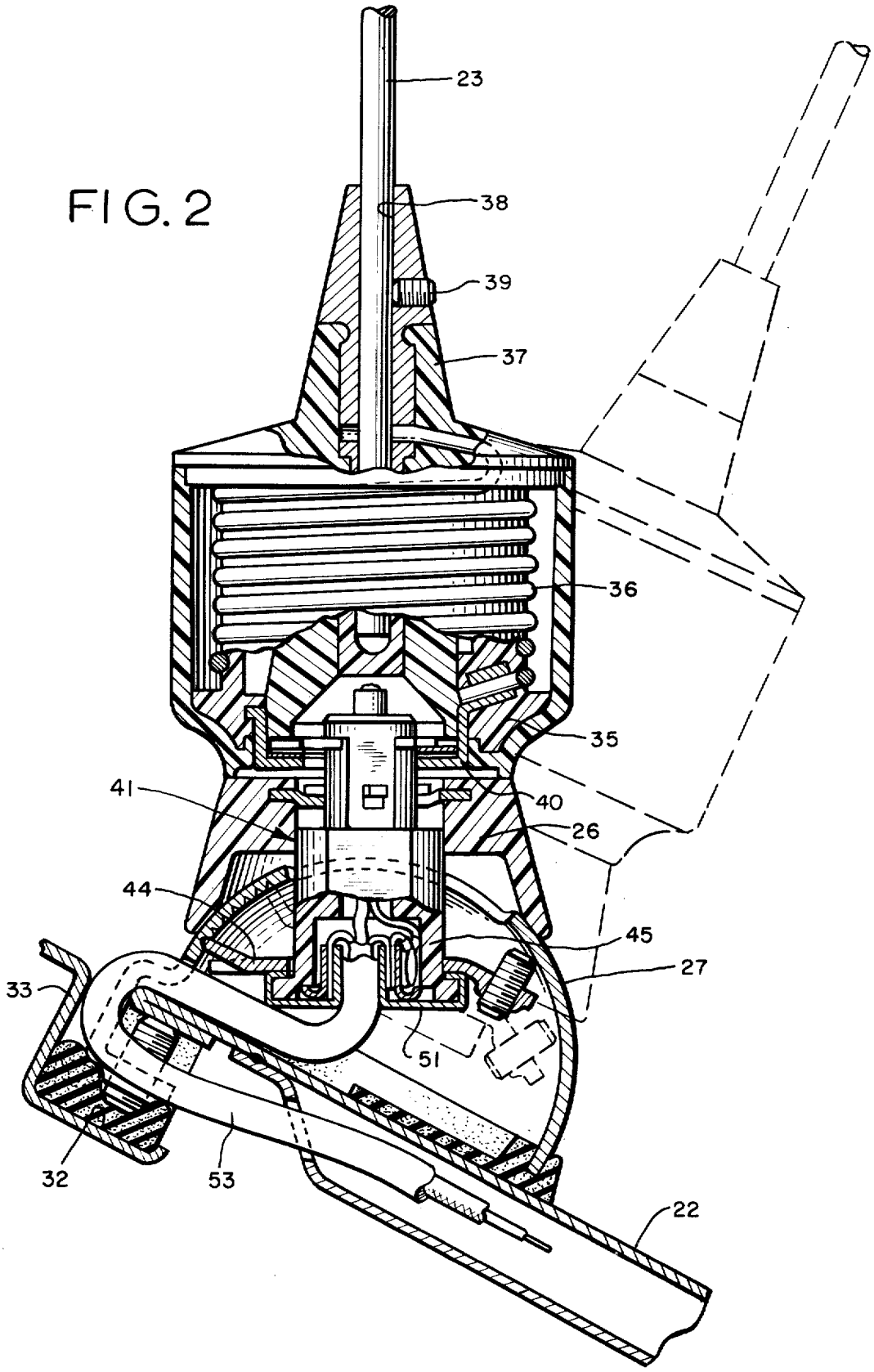
FIG. 2 is an enlarged cross-sectional view of the mobile antenna taken along line 2—2 of FIG. 1.

Referring to FIG. 2, the antenna base 24 includes a generally cylindrical core assembly 35 on which an antenna loading coil 36 is wound. The loading coil is electrically connected at its upper end to an end fitting 37, which includes an axially extending bore 38 for receiving radiating element 23. A set screw 39 retains the radiating element in position. The lower end of the loading coil is electrically connected to an annular electrically conductive contact plate 40 which forms in conjunction with other elements of the base, a socket in which a mounting pin 41 is received in a quick-release bayonet-type connection. The quick-release connection allows the antenna to be conveniently removed from the antenna mounting assembly 25 when the antenna is not in use.

Mounting pin 41, which is preferably cylindrical in form, is removably attached at one end to base 24 and skirt 27 by respective sets of radially projecting mounting ears 42*a* and 42*b* contained within respective axially spaced planes perpendicular to the axis of the pin. Ears 42*a* engage complimentary detent surfaces on contact plate 40, and ears 42*b* engage detent surfaces on a skirt locking plate 43 embedded in skirt member 26 to form quick-release bayonet-type connections to these elements. The other end of mounting pin 41 is retained within the interior of shell 27 by an adjustable locking plate 44, which causes pin 41, and hence skirt 26, to be drawn into tight friction engagement with the exterior surface of shell 27.

As shown in FIG. 2, locking plate 44 may occupy a plurality of different positions within shell 27, each providing a different mounting angle for the antenna with respect to the underlying support surface 22. By changing the position of plate 44 inside shell 27 as shown the mounting angle of the antenna is changed in an arcuate manner, thus enabling the antenna to be positioned vertically even when the body panel 22 to which the antenna is affixed is inclined from the horizontal.

Figure 4:
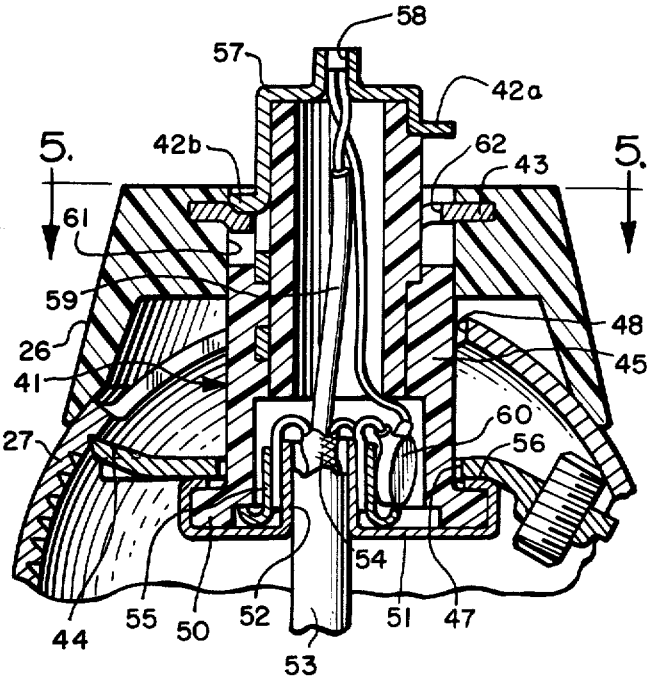
FIG. 4 is an enlarged cross-sectional view of the mounting portion of the mobile antenna taken along line 4—4 of FIG. 3.
Figure 3:
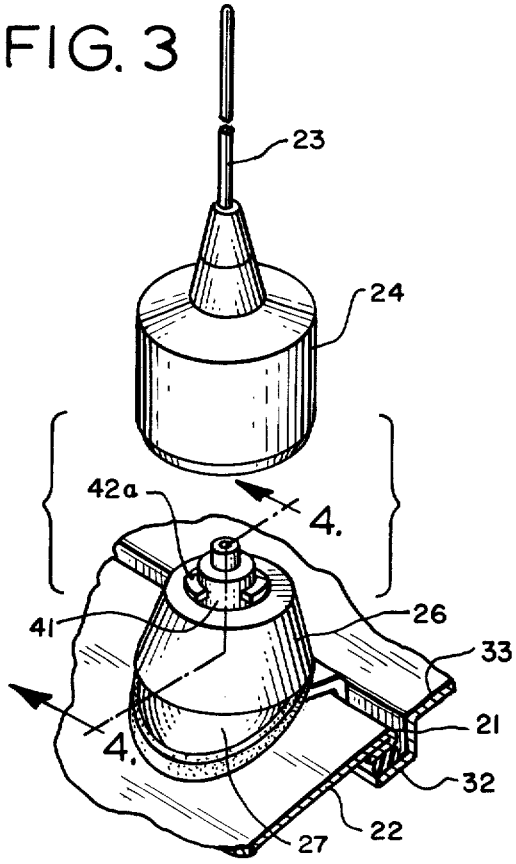
FIG. 3 is a perspective view of the mobile antenna shown in FIG. 1 wherein the base member has been removed from its mounting.

Referring to FIGS. 3 and 4, the mounting pin 41 comprises an injection-molded generally cylindrical housing 45 having a pair of flat diametrically opposed surfaces thereon for preventing rotation of the member. The pin extends through an aperture 47 in locking plate 44, and through an aperture 48 in shell 27, each of which include opposed flat surfaces which prevent rotation of the mounting pin with respect to the respective elements. The bottom end of housing 45 includes an enlarged rim portion 50 which prevents the bottom end of the pin from passing through apertures 47 and 48. A metal end cap 51 fitted over flange portion 50 includes a central aperture 52 through which a coaxial cable 53 is received. The rim of aperture 52 is inwardly flanged, and the shield 54 of cable 53 is folded back over the flange and compressed into electrical contact therewith by means of a collar 55. The rim of cap 51 is folded back over flange 50, forming an annular contact surface 56 which establishes electrical contact with locking plate 44. Since locking plate 44 is electrically conductive in contact with shell 27, which is also electrically conductive and in contact with body panel 22, the shield of coaxial cable 53 is effectively connected to ground, thereby providing a ground plane for the antenna.

Mounting pin 41 includes at the top end of housing 45 a second electrically conductive end cap 57. This end cap includes a central axially-aligned aperture 58 in which the center conductor 59 of coaxial cable 53 is received. Radially-projecting tabs 42*a* and 42*b* are struck from the cap, and the body of the cap is embedded in housing 45 to maintain the cap in position. A capacitor 60 is connected between end caps 51 and 57 within the housing. Following assembly, aperture 58 may be either soldered or crimped to secure lead 59 and the lead of capacitor 60. In order to form tabs 42*a* and 42*b* pairs of vertical slits may be made in the side wall of end cap 57 and the metal between the slits may be bent outwardly to form the respective tabs. In order to limit the outward projection of tabs, the end portions (not shown) of the tabs may be removed. The respective pluralities of tabs 42*a* and 42*b* are positioned equidistantly adjacent tabs in the opposite plane such that all tabs are visible from the top of the mounting pin, i.e., each lower tab 42*b* is not positioned directly below an upper tab 42*a*. This staggered double row of tabs provides a dual quick-connect function between the mounting pin 41, the skirt member 26, and the antenna base 24.

Figure 5:
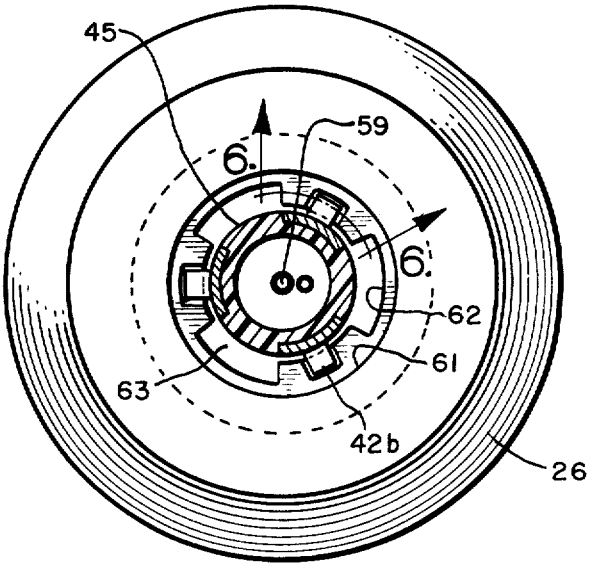
FIG. 5 is a plan view, partially in cross-section, taken along line 5—5 of FIG. 4.
Figure 6:
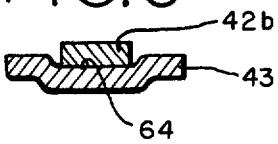
FIG. 6 is an isolated cross-sectional view taken along line 6—6 of FIG. 5.

Referring to FIG. 5, skirt member 26 includes an axially aligned aperture 61 through which mounting pin 41 extends. Retaining plate 43 extends across this aperture in a plane generally perpendicular to the axis, and includes an aperture 62 coaxial to aperture 61. Aperture 62 includes around its periphery a plurality of keyways 63 for receiving tabs 42*b*, and a plurality of adjacent detent surfaces 64 for engaging the tabs as the mounting pin is rotated with respect to the skirt member. In this way, a bayonet-locking arrangement results, allowing the skirt to be locked in position by merely rotating the mounting pin through approximately 160° after the pin has been inserted to position tabs 42*b* above plate 43. As shown most clearly in FIG. 5, tabs 42 and detent portions 64 are each positioned at 120° angles around their respective members such that the tabs engage their respective detent at the same instant of rotation of skirt 26.

The antenna mounting assembly 25 is shown in FIG. 3 as it appears with the antenna radiating element 23 and base 24 removed. The skirt member 26 remains rigidly mounted on shell 27 and the end cap 57 of the bayonet mounting pin 41 extends upwardly of the central skirt aperture. To reinstall the antenna, all that is necessary is to insert base member 24 on the mounting pin, and then rotate the base until it becomes locked on the pin. Alignment of the antenna is not changed and connections to the antenna are automatically established.

Referring to FIGS. 7-11, the housing 35 of base 24 defines a recess 70 within which mounting pin 71 is received. Contact plate 40 extends across this recess in a plane generally perpendicular to the axis thereof, and includes a concentric recess 71 dimensioned to receive pin 41. A plurality of keyways 72 and adjacent detent surfaces 73 are provided about the periphery of aperture 71 to engage tabs 42*a*. As best seen in FIG. 10, the contact plate is cup-shaped, with aperture 71 being located on the bottom surface thereof, and with a contact portion 74 being provided on one sidewall thereof. One end of inductance winding 36 is connected to contact 74 by either crimping or soldering. Since contact 74 is connected to tabs 42*a*, and since end cap 57 is connected to the center conductor of coaxial cable 53, an electrical connection is automatically established between the antenna and associated equipment when the antenna is installed on the antenna mounting assembly.

Immediately inwardly adjacent contact plate 40 is positioned a spring washer 75 which includes an aperture 76 shaped similarly to aperture 71 in cap 40. An upwardly projecting tab 77 engages a recess in washer 75 to prevent rotation of the washer with respect to contact plate 40. The surface of washer 75 includes three upwardly extending ramps 78 radially aligned with the detent portions of aperture 71.

When installing base 24 on the mounting assembly the top portion of mounting pin 41 is inserted in recess 70 with the upper tabs 42*a* of the pin aligned with keyways 72 of contact plate 40. The base is then rotated, causing tabs 42*a* to pass over the ramp portions 78 of washer 75, until an over-center condition is reached and one of the tabs abuts alignment tab 77, as shown in FIG. 11. The leading edges of tabs 42*a* may be downwardly bent as shown to enhance the over-center locking action of washer 75.

Figure 12:
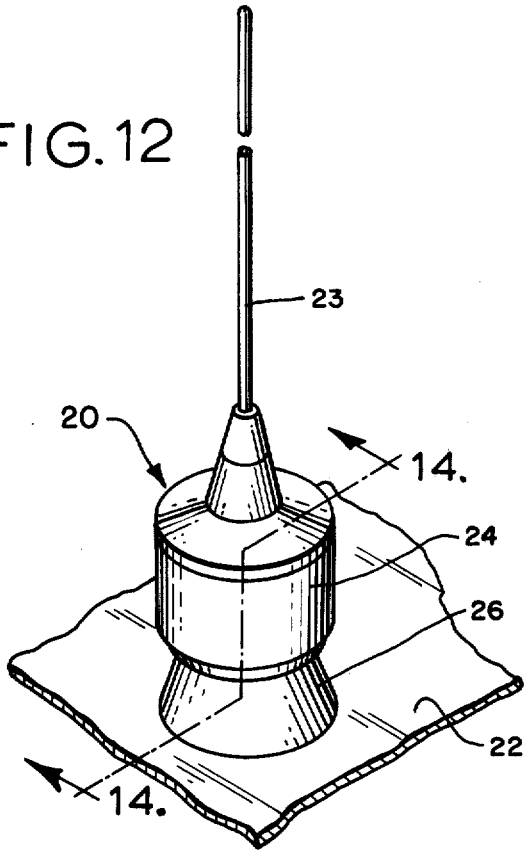
FIG. 12 is a perspective view of the mobile antenna showing an alternate mounting arrangement.
Figure 13:
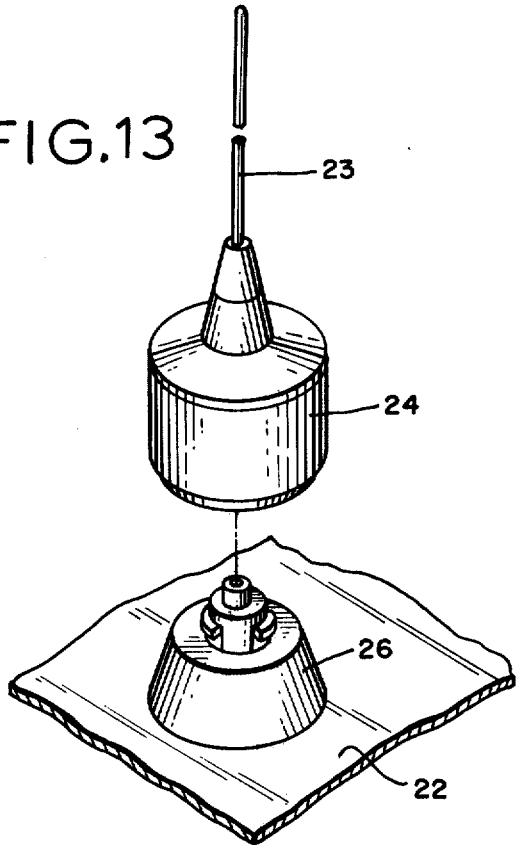
FIG. 13 is a perspective view similar to FIG. 12 showing the antenna base removed from the mounting assembly of the antenna.
Figure 14:
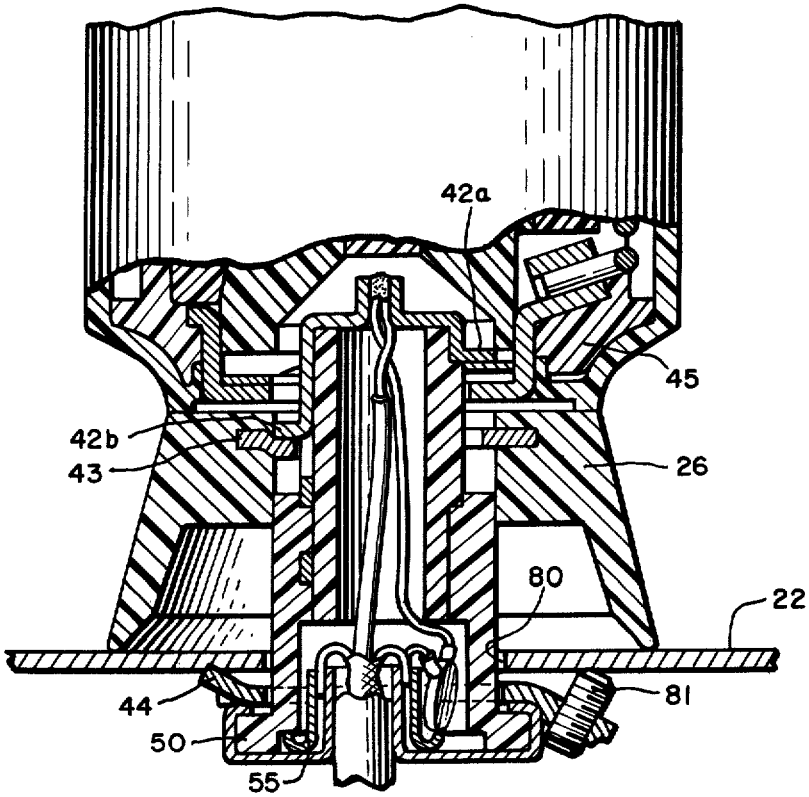
FIG. 14 is an enlarged front elevational view partially in cross-section of the antenna base and mounting assembly of FIGS. 12 and 13 taken along line 14—14 of FIG. 12.

Referring to FIGS. 12–14, the bayonet mounting pin 41 and skirt member 26 may also be utilized to mount the antenna base directly to a body panel. In this application shell 27 is removed from pin 71, and the pin is inserted through an aperture 80 provided in the body panel. The skirt 26 is then drawn against the exterior surface of the body panel, thus mounting the antenna directly to the panel.

As shown in FIG. 14, in the alternate mounting arrangement the bottom edge of skirt member 26 directly engages the exterior surface of body panel 22. When the bayonet mounting pin 41 is inserted through the body panel aperture 80, the flange 50 of the pin member is forced away from the interior surface of panel 22 by locking plate 44, which is pivoted against the panel at one end and forced away from the panel at its other end by an adjustable stop in the form of a set screw 81. This forces flange portion 26 against panel 22, thereby retaining the antenna in position. It should be noted that all of the parts utilized in the alternate mounting arrangement are adaptable to the adjustable antenna mounting arrangement shown in FIGS. 1–4.

Thus, an antenna has been shown which can be easily mounted on a vehicle body panel, either in a fixed or adjustable angular alignment configuration. The antenna is simple in construction, and can be economically fabricated using conventional manufacturing techniques. Moreover, the antenna can be readily removed and without the use of tools and without affecting the reinstalled angular alignment of the antenna.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A mobile antenna for mounting to a body panel comprising, in combination:

a radiating element;

a base member for supporting said radiating element in a substantially vertical position, said base member including a housing defining a socket, and means comprising a mounting pin for mounting said base member to said body panel, said mounting pin being adapted at one end for insertion into said socket and at the other end for securement to said body panel, said base member housing including a plurality of circumferentially spaced keyways adjacent said socket, with locking means between adjacent keyways, said pin including a first plurality of projecting tabs in mating relationship with said keyways whereby insertion and twisting of said pin into said socket causes said tabs to pass through said keyways and engage said locking means to axially lock said mounting pin and base member together.

2. A mobile antenna in accordance with claim 1 further comprising a skirt between said base and said body panel, said skirt including opening means for receiving said pin therethrough, a plurality of circumferentially spaced keyways in said skirt adjacent said opening means, and locking means associated with said skirt between each adjacent pair of spaced keyways, said pin further including a second plurality of projecting tabs intermediate the ends of said pin matingly engageable through the skirt keyways to engage said locking means upon inserting and twisting of said pin into said skirt.

3. A mobile antenna in accordance with claim 1 wherein said tabs and locking means are electrically conductive, said locking means electrically communicating with said radiating element, whereby said pin is in electrical communication with said radiating element when said base and pin are locked together.

4. A mobile antenna in accordance with claim 3 wherein said mounting pin includes an electrically conductive end cap on said one end thereof, which includes said first plurality of projecting tabs.

5. A mobile antenna in accordance with claim 4 wherein said end cap further includes said second plurality of projecting tabs.

6. A mobile antenna in accordance with claim 4 further comprising a second end cap over the other end of said mounting pin, said second cap including an aperture for receiving said coaxial cable, and connection means for establishing an electrical contact between said second end cap and the shield of said coaxial cable, and between said second end cap and said body panel surface, whereby a ground is established for the antenna.

7. A mobile antenna as defined in claim 6 wherein said aperture on said second end cap includes an inwardly flared rim portion, said shield of said coaxial cable is folded back over said flared rim portion, and said connection means include a collar force-fit over said flared portion to retain said shield in contact with said end cap.

8. A mobile antenna as defined in claim 6 wherein said pin includes at said other end a rim portion of increased diameter and wherein the periphery of said second end cap extends over said rim portion so as to present a contact surface.

9. A mobile antenna as defined in claim 8 wherein said connection means comprise a locking plate disposed between the inside surface of said body panel and said rim portion, said locking plate including adjustable stop means for maintaining contact between said body panel and said contact surface.

10. A mobile antenna in accordance with claim 8 wherein said connection means further comprises a conduction hemispherical carried by said body panel, said rim being positioned within said said shell and extending through opening means therein, and a locking plate disposed between the inside surface of said shell and said rim portion, said locking plate including adjustable stop means for maintaining contact between said rim and said shell.

11. A mobile antenna in accordance with claim 3 wherein said base member comprises an electrically nonconductive housing having a recess therein defining said socket for receiving said pin, and contact means including an electrically conductive contact member carried in said housing, said contact member having a central aperture for receiving said pin and a plurality of keyways about said aperture with a detent surface between adjacent keyways for engaging said tabs to establish a mechanical and electrical connection between said pin member and said base member.

12. A mobile antenna assembly as defined in claim 11 wherein said contact member is generally cup-shaped, said aperture being located on the bottom thereof, and wherein the sidewalls thereof are embedded in said base member housing.

13. A mobile antenna assembly as defined in claim 12 wherein said cup-shaped contact member includes a substantially flat sidewall portion preventing rotation thereof with respect to said housing.

14. A mobile antenna as defined in claim 11 wherein said base member includes an electrically-conductive annular spring member having a central aperture complimentary keyed and overlying said aperture of said contact member between said tab members and said contact member.

15. A mobile antenna as defined in claim 14 wherein said spring member includes ramp portions for receiving said tabs of said mounting pin in locking engagement.

16. A mobile antenna as defined in claim 14 wherein said contact member includes an axially projecting tab, and wherein said spring member includes a recess for receiving said tab to maintain said contact member and said spring member rotatably keyed.

17. A mobile antenna for mounting to a body panel comprising, in combination:

a radiating element;

a base member for supporting said radiating element in a substantially vertical position, said base member including a housing defining a socket, means comprising a mounting pin for mounting said base member to said body panel, said mounting pin being adapted at one end for insertion into said socket and at the other end for securement to said body panel, said base member housing including a plurality of circumferentially spaced keyways adjacent said socket, with locking means between adjacent keyways, said pin including a first plurality of projecting tabs in mating relationship with said keyways whereby insertion and twisting of said pin into said socket causes said tabs to pass through said keyways and engage said locking means to axially lock said mounting pin and base member together, and a skirt between said base and said body panel, said skirt including opening means for receiving said pin therethrough, a plurality of circumferentially spaced keyways in said skirt adjacent said opening means, and locking means associated with said skirt between each adjacent pair of spaced keyways, said pin further including a second plurality of projecting tabs intermediate the ends of said pin matingly engageable through the skirt keyways to engage said locking means upon inserting and twisting of said pin into said skirt, said first plurality of tabs and said base member locking means being electrically conductive, said base member locking means electrically communicating with said radiating element, whereby said pin is in electrical communication with said radiating element when said base and pin are locked together.

18. A mobile antenna in accordance with claim 17 wherein said mounting pin includes an electrically conductive end cap on said one end thereof, which includes said first and second pluralities of projecting tabs.

19. A mobile antenna in accordance with claim 18 further comprising a second end cap over the other end of said mounting pin, said second cap including an aperture for receiving said coaxial cable, and connection means for establishing an electrical contact between said second end cap and the shield of said coaxial cable, and between said second end cap and said body panel, whereby a ground is established for the antenna.

20. A mobile antenna in accordance with claim 17 wherein said other end of said pin includes a rim portion of increased diameter and further comprising a second end cap over said rim portion to present a contact surface facing the inside surface of said body panel, said second cap including an aperture for receiving said coaxial cable, and connection means for establishing an electrical contact between said second end cap and the shield of said coaxial cable, and between said second end cap and said body panel, whereby a ground is established for the antenna, said connection means comprising a locking plate disposed between the inside surface of said body panel and said rim portion, said locking plate including adjustable stop means for maintaining contact between said body panel and said contact surface.

21. A mobile antenna for mounting to a body panel comprising, in combination:

a radiating element;

a base member for supporting said radiating element in a substantially vertical position;

an electrically conductive hemispherical shell comprising means for mounting said shell to said body panel in an electrically conductive relationship;

a mounting pin received within an aperture in said shell said pin comprising a rim at one end disposed within said shell, and bridging said aperture, including an electrically conductive end cap thereover in communication with said shell, a skirt carried on the surface of said shell and including an aperture for receiving the other end of said pin therethrough, projecting means associated with the other end of said pin for securing said base member to said other end of said pin.

22. A mobile antenna in accordance with claim 21 further comprising a coaxial cable, said end cap being in electrical communication with the shield of said cable for grounding said antenna to the body panel.

23. A mobile antenna in accordance with claim 22 where said end cap includes an aperture for receiving the coaxial cable, said aperture including an inwardly flared portion, the shield of said coaxial cable being folded back over said flared portion, and a collar force-fit over said flared portion to retain the shield in contact with said end cap.

* * * * *